United States Patent [19]

Firsty

[11] 4,147,010

[45] Apr. 3, 1979

[54] PHOTOELECTRICALLY CONTROLLED GARMENT BAGGER

[75] Inventor: Sherman Firsty, Dobbs Ferry, N.Y.

[73] Assignee: Gloran Plastic, Inc., Dobbs Ferry, N.Y.

[21] Appl. No.: 866,249

[22] Filed: Jan. 3, 1978

[51] Int. Cl.[2] ..... B65B 57/02; B65B 25/20

[52] U.S. Cl. ..... 53/64; 53/241

[58] Field of Search ..... 53/64, 241, 256

[56] References Cited

U.S. PATENT DOCUMENTS

| | | | |
|---|---|---|---|
| 3,895,480 | 7/1975 | Lombardo | 53/241 X |
| 3,961,460 | 6/1976 | Jelling et al. | 53/241 X |

*Primary Examiner*—Travis S. McGehee

*Attorney, Agent, or Firm*—Jacob L. Kollin

[57] ABSTRACT

A photoelectrically controlled garment bagger. The bagger comprises a support frame for the bagger housing and for a roll of translucent sequentially detachable bags. The roll is provided with transverse perforations along which individual bags may be detached. Each bag is provided with an opaque spot located a predetermined distance from the perforations. The bags travel over a roller assembly.

A photoelectric light responsive control unit employing a retroflector is mounted in the housing above the path of travel of the opaque spots on the bags. When an opaque spot on a bag interrupts the light beam of the control unit, a clamp bar in the housing is actuated to halt the movement of the roll of bags for a length of time sufficient to enable an operator to detach a bag and spread it on a garment using a spreader device secured to the housing.

6 Claims, 3 Drawing Figures

PHOTOELECTRICALLY CONTROLLED GARMENT BAGGER

FIELD OF THE INVENTION

Figure 1:
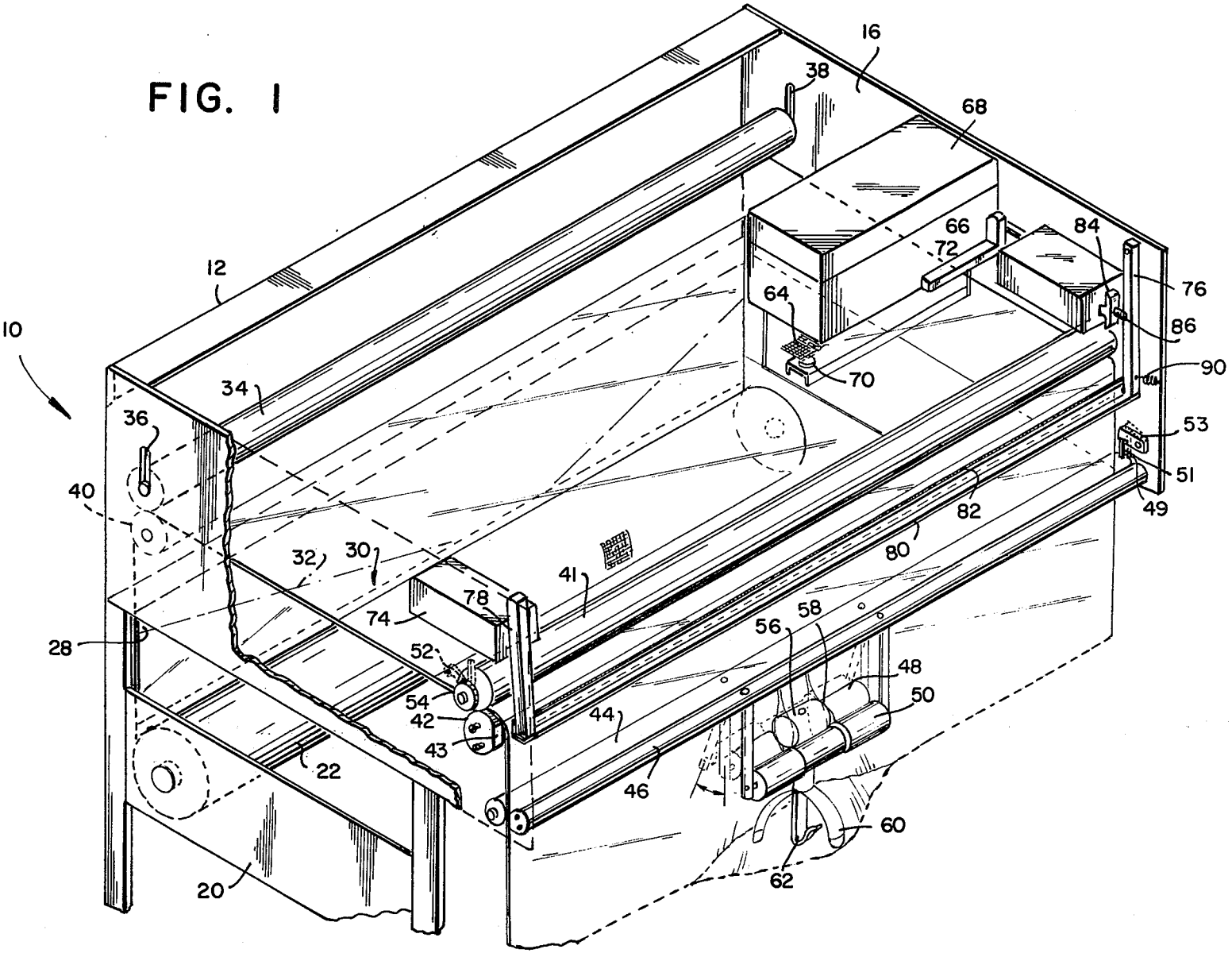

The present invention relates to an apparatus for detaching individual bags arranged in a continuous series on a roll, in general, and in particular to such an apparatus employing photoelectric means for interrupting the movement of the bags at predetermined intervals to allow the bags to be detached from the rolls.

BACKGROUND OF THE INVENTION

Garment manufacturers and cleaning stores employ polyethelene film bags for covering garments. These bags are torn off a roll containing a plurality of bags and susequently drawn by an operator over the garment which hangs on a garment hanger, suspended on a hanger hook. A somewhat complicated, time-consuming, manually controlled mechanism is presently employed to deliver the bags to the bagging station.

The present device employs a simplified mechanism using a photoelectric control unit. The film is provided with a dark spot of any configuration on each bag. It is threaded through rollers and between the photoelectric control unit and a target (retroflector). When the machine is in operation, the clerk-operator pulls down a predetermined length of film for covering a garment. As he does this, solenoids energize a clamping bar when the dark spot on the bag passes the photoelectric control unit, thereby clamping the following bag for a preset time. The solenoids are automatically de-energized after a preset time, thereby releasing the clamping bar and the next bag for the following operation.

SUMMARY OF THE INVENTION

It is an object of the invention to provide an improved bagging operation for facilitating the application of bags to cover garments.

Another object of the invention is to provide photoelectric means which will interrupt the movement of the bags, arranged in a continuous series on a roll, at predetermined intervals, to enable an operator of the above apparatus to tear off the bags.

Yet another object of the invention is to provide such an apparatus which will enable a speedy and efficient application of bags to cover garments.

Still another object of the invention is to provide such an apparatus which is simple and sturdy in construction and operation.

Figure 2:
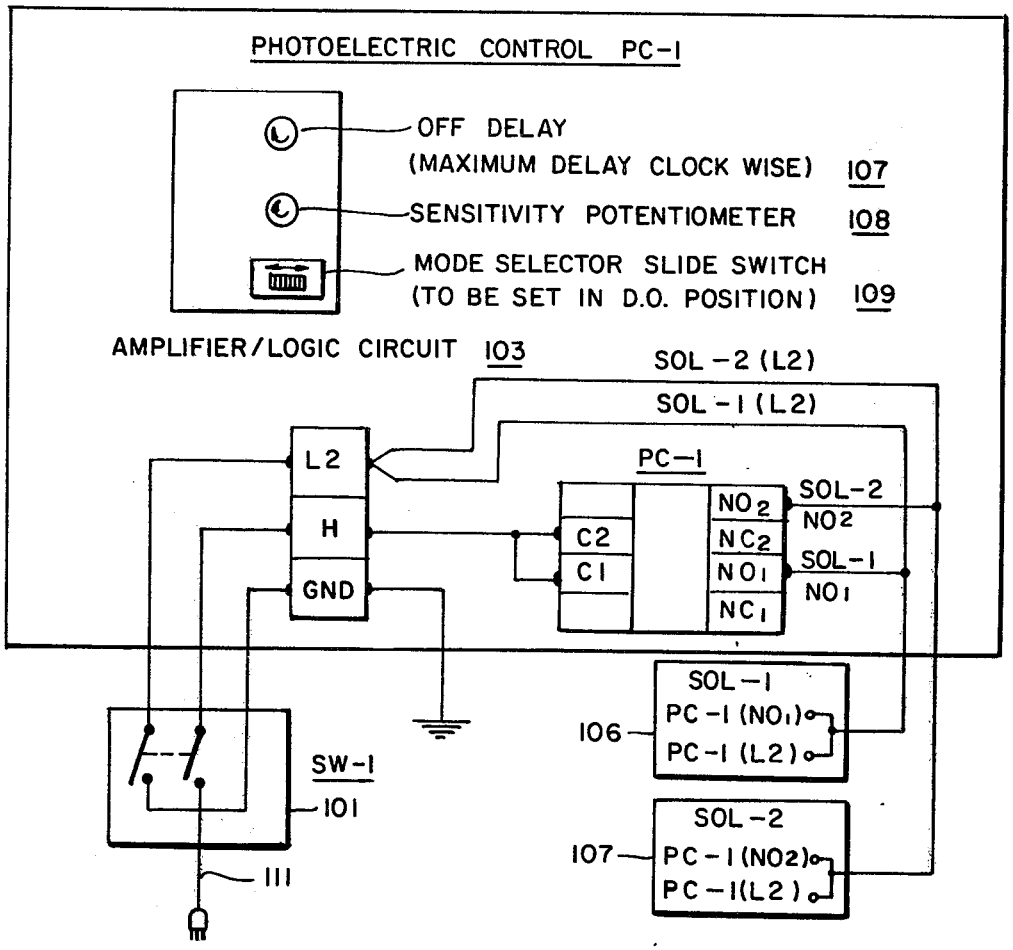
Figure 3:
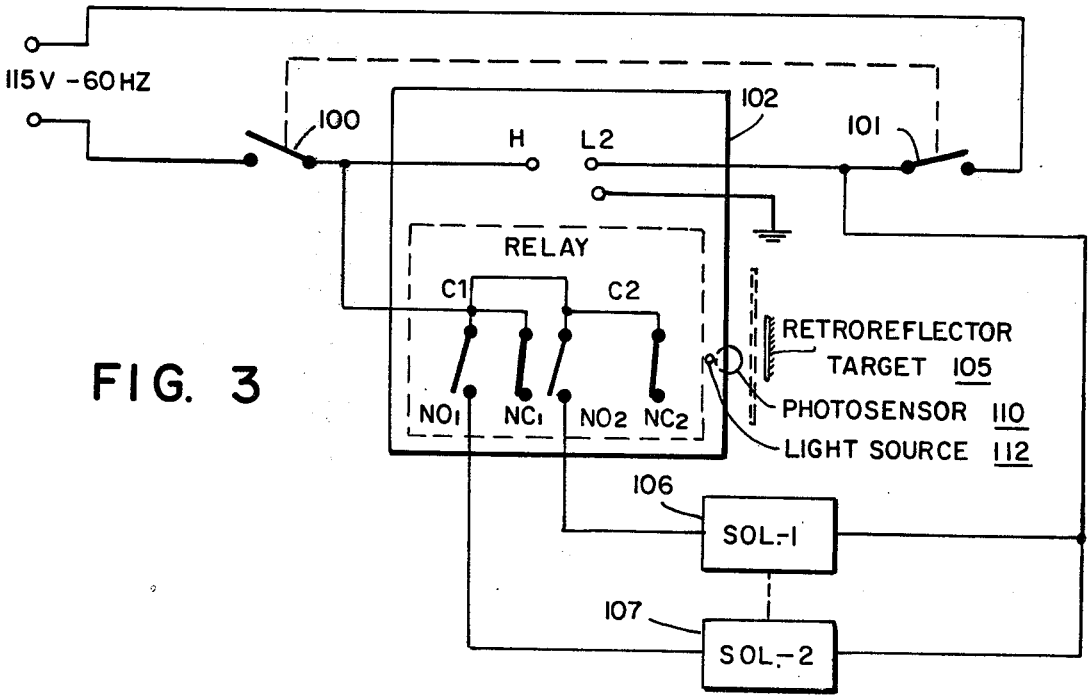

These and other objects of the invention will become apparent from the following description and drawings forming a part of this specification. It is to be understood that these are given by way of illustration only, and that changes in detail construction and dimensions may be made without affecting the scope of the invention sought to be protected. In the drawing:

FIG. 1 is a perspective view, partly in phantom of the bagger, with the cover removed, FIG. 2 is an elementary control diagram of the device and FIG. 3 is a diagram of the photoelectric control employed in the bagger.

Referring now to the drawing in detail, the electronically controlled bagger according to the invention comprises a housing 8 mounted on a floor support frame 10 partly shown in FIG. 1. The housing comprises a rear wall 12, a pair of side walls 14,16 and a cross member 18. Mounted as partly shown in FIG. 1 is a roll 24 of sequentially arranged polyethelene bags, such as 26, 28. The roll of film is provided with transverse perforations 30, along which the bags may be detached from one another.

As viewed in the direction of travel of the bags, indicated by arrows, the leading edges of bag 26 will remain open, while the following edges of bags, such as 28 which have been heat sealed during manufacture will remain substantially closed after these bags will have been detached from one another along the perforations 30.

The film forming the bags travels along a path between movable roller 34 mounted in slots 36, 38 provided in the side walls of the housing, fixed position roller 40, movable roller 41, fixed position roller 42 provided with a flat, output pivoting roller 44, fixed output roller 46 and output rollers 48, 50 to the spreading device indicated by arrow 52. Output roller 48 may be swung out for insertion or removal of a hook support 56 and is provided with a notch 49 in which is received a pin 51 secured to a swingable release member 53.

A pawl and ratchet device 52, 54 is provided for roller 40 to prevent it from turning in a direction opposite to the travel of the film of bags.

The spreading device comprises a hook support 56, a cone 58 preferably of aluminum, a stainless steel spreader 60 and a garment hanger 62.

Each of the bags is provided with an imprinted or sprayed opaque spot 64 which, as previously mentioned, may be of any predetermined configuration, such as annular, rectangular, polygonal, oval, star-shaped, etc. Secured to a bracket 66 is a photoelectric control device 68. The position of the device may be adjusted by moving the bracket along slot 70 and tightening the bolt 72. The control device is responsive to light intensity change at the photoreceiver and is set at "dark" responsive when the opaque spot 64 arrives in a position between the photoelectric control and retroflector 70 the photoelectric cell and retroflector being designed to be "dark responsive" to the particular shape only of the opaque spot on the bags. A pair of solenoid devices such as 72, 74 are energized by the control device. The armatures' end portions of the solenoids are connected to a clamp bar assembly comprising a pair of pivotable 76, 78 integral with clamp bar 80 which is provided with a resilient pad 82. The armature end portions, one of which 84 may be seen in FIG. 1 are connected to the rods through the intermediary of expansion springs such as 86, which functions to prevent the solenoid armature from chattering when it is drawn into the solenoid coil. When the solenoid devices are energized, the armatures pull the clamp bar 80 against the polyethelene film and clamp it against flat 43, thereby arresting the film's travel.

The opaque spot 64 on each of the bags is arranged at a relative predetermined distance to the next preceding bag so that the clamp bar assembly is operated by the solenoids not later than the time at which the transverse seam of one bag abuts a garment on a hanger.

The clamping device continues in operation when the spreading device is at least substantially completely within the next sequential bag, or when the bag correctly sits over the garment. For this purpose, there is provided a timing mechanism in the photoelectric control device which may be adjusted to release the clamp bar at a predetermined time following the clamping of the polyethelene film. As soon as the solenoids are deenergized, the clamp bar is pulled back by springs 90 and its return travel is stopped by a stop pin.

The electrical circuit for the operation of the photoelectrically controlled garment bagger is shown in FIGS. 2 and 3. Microswitches 100, 101 control the circuit of the two solenoids. 102 is the self-contained photoelectrical control, phototransistor type 105–103 VAC using an incandescent lamp, plug-in logic card and a plug-in relay, double pole, double throw relay, 10 amperes, 115 VAC. The unit is threshold responsive and is set at "dark responsive", minimum signal ratio 10:1, requiring no minimum rate of change. Sensitivity adjustment is set for the operating point at a certain value of illuminated cell resistance 106, 107. One shot logic is employed, i.e. output energized, relays contacts close instantly when input is signaled and de-energized after adjustable dwell time 0.5 to 15 sec. regardless of input signal duration. The solenoids energize when dark spot on bag passes photoelectric control, thereby clamping bag; de-energize after preset (adjustable) time releasing bag for the next operation. Numeral 110 indicates the photosensor and 112 the light source.

Power is supplied from an ordinary 115V, 60 HZ grounded source through a 3 wire electric cord.

The photoelectric system consists of a control base including a socket for an amplifier/logic circuit, a step down transformer to power the light source, the light source and photoreceiver, an output device. There is also included a separately mounted retroreflector.

The light source used as in incandescent lamp rated 4.5–6 volts, 60 HZ.

The photoreceiver is a unit consisting of photosensor, focusing lens, and protective enclosure. The photosensor converts a light signal to an electrical signal. Electrical conductance of the entire layer of cadmium selenide (CdSe) changes with light intensity.

Retroflective scan technique is employed by mounting the retroflector so as to return the light signal along the same path it is sent. In order to provide the best signal ratio and control reliability a clear (transparent) film with a black mark is utilized to provide a high contrast for detection.

The amplifier circuit utilized is threshold responsive, i.e., response is to a change in light intensity at the photosensor. The operate point (threshold) is determined by a sensitivity adjustment provided in the circuit and located on the amplifier/logic card. Depending on where the adjustment is set, the illuminated photosensor resistance that energizes output is between 100 ohms and 30 kilohms. When the resistance decreases below the threshold setting (detects black mark) the system operates.

The circuit contains an operating mode selector which in this application is set in the Dark operated position. Dark operated means the output energizes when the sensor is dark, i.e., when the light source beam is blocked.

The logic circuit provides for a "one-shot pulse" i.e., momentary input signal provides instant response of circuit which only recycles when a new input signal is sensed. A new input signal is deemed as the next black mark on the film.

The logic circuit also provides a time controlled energization of the output device so that the output device energizes instantly on a dark responsive output of the photosensor and after an adjustable time delay (0.5 to 12 seconds) the output device deenergizes. The adjustable time delay is contained on the amplifier/logic circuit card.

The output device is an electromechanic relay with double pole double throw contacts.

115V, 60 HZ solenoid valves are powered from the same line as the Photoelectric control and are each independently controlled through each normally open pole of the output device (relay).

The action, therefore, through the above described circuit components as shown on the elementary schematic diagram is as follows:

An operator pulls the transparent film, through the machine. When the preprinted spot on the film breaks the path of light between the photosensor and the retroflector a signal is sent to the output relay which energizes the two solenoid valves which pull the clamping bar in, restraining the film which allows for easy tearing of the film at the perforations. After a few seconds delay (adjustable) the output device deenergizes allowing the operation to be repeated.

I claim:

1. A photoelectrically controlled garment bagger, comprising a support frame, a housing mounted on said frame and having a rear wall and a pair of side walls, a roll of translucent polyethelene sequentially detachable bags mounted in said frame, said roll being provided with transverse perforations along which the bags may be detached from one another, said bags each being provided with an opaque spot a predetermined distance from said perforations, said bags further having leading edges forming an opening portion and following edges forming a substantially heat sealed portion, a roller assembly in said housing for travel of said roll of bags, a clamp bar in said housing for braking the travel of said bags, photoelectric light responsive control means positioned in said housing above the path of travel of said bags, means in said housing for operating said clamp bar, said operating means being energized and deenergized from a current source through said control means when an opaque spot on each of said bags arrives in a predetermined position with relation to said light sensitive control means, a spreading device for spreading the leading portions of said bags mounted on the housing, for pulling the bags over garments said roller assembly comprising a first movable roller, a first fixed roller, a second movable roller, a second fixed position roller provided with a flat, a first pair of output rollers, all said rollers being mounted between said housing's sides, a second pair of output rollers spacedly mounted on one of said first pair of output rollers and a pawl and ratchet mechanism on one of said sides for preventing said second movable roller from reversing its travel direction opposite the travel of said bags.

2. The device as claimed in claim 1, the spreading device comprising a hook support, a cone, a stainless steel spreader and a garment hanger.

3. The device as claimed in claim 2, wherein said control device is adjustably mounted in said housing and is set at "dark" responsive position and is provided with a lamp and retroflector spaced from said lamp in the path of travel of said opaque spots on said bags.

4. The device as claimed in claim 3, further provided with a pair of solenoids mounted in said housing for operating said clamp bar, said solenoids being actuated by an electrical energy source through said photoelectric control device.

5. The device of claim 4, said solenoids having armatures connected to said clamp bar and springs connected to said armatures and said housing for preventing chatter of said armatures when these are drawn into a solenoid coil.

6. The device as claimed in claim 5, wherein said photoelectric control means is provided with a timing mechanism for maintaining the clamp bar in clamping position to permit tearing off a bag at a perforation until the transverse seam of the bag abuts a garment on a hanger.

* * * * *